US007230179B1

(12) United States Patent
Ertl

(10) Patent No.: US 7,230,179 B1
(45) Date of Patent: Jun. 12, 2007

(54) STRAY VOLTAGE SUPPRESSION DEVICE

(76) Inventor: Scott Martin Ertl, 7775 Hwy. 10 East, Marshfield, WI (US) 54449

( * ) Notice: Subject to any disclaimer, the term of this patent is extended or adjusted under 35 U.S.C. 154(b) by 23 days.

(21) Appl. No.: 11/268,188

(22) Filed: Nov. 7, 2005

Related U.S. Application Data

(60) Provisional application No. 60/638,508, filed on Dec. 22, 2004.

(51) Int. Cl.
*H01R 4/66* (2006.01)

(52) U.S. Cl. ..... 174/5 SG; 174/5 R; 174/6; 174/7

(58) Field of Classification Search ..... 174/5 R, 174/5 SG, 6, 7
See application file for complete search history.

(56) References Cited

U.S. PATENT DOCUMENTS 6,133,656 A * 10/2000 Hisey ..... 310/68 C
2002/0148624 A1* 10/2002 Gobelhaider ..... 174/6

* cited by examiner

*Primary Examiner*—Jinhee Lee
(74) *Attorney, Agent, or Firm*—Craig A. Fieschko, Esq.; DeWitt Ross & Stevens S.C.

(57) ABSTRACT

A stray voltage suppression device includes a motor-driven conductive vane which rotates in planes oriented at least substantially parallel to the ground, with the motor casing being connected to the ground below. The device has been found useful to reduce or eliminate stray voltage about the area at which it is installed.

20 Claims, 1 Drawing Sheet

THE FIGURE
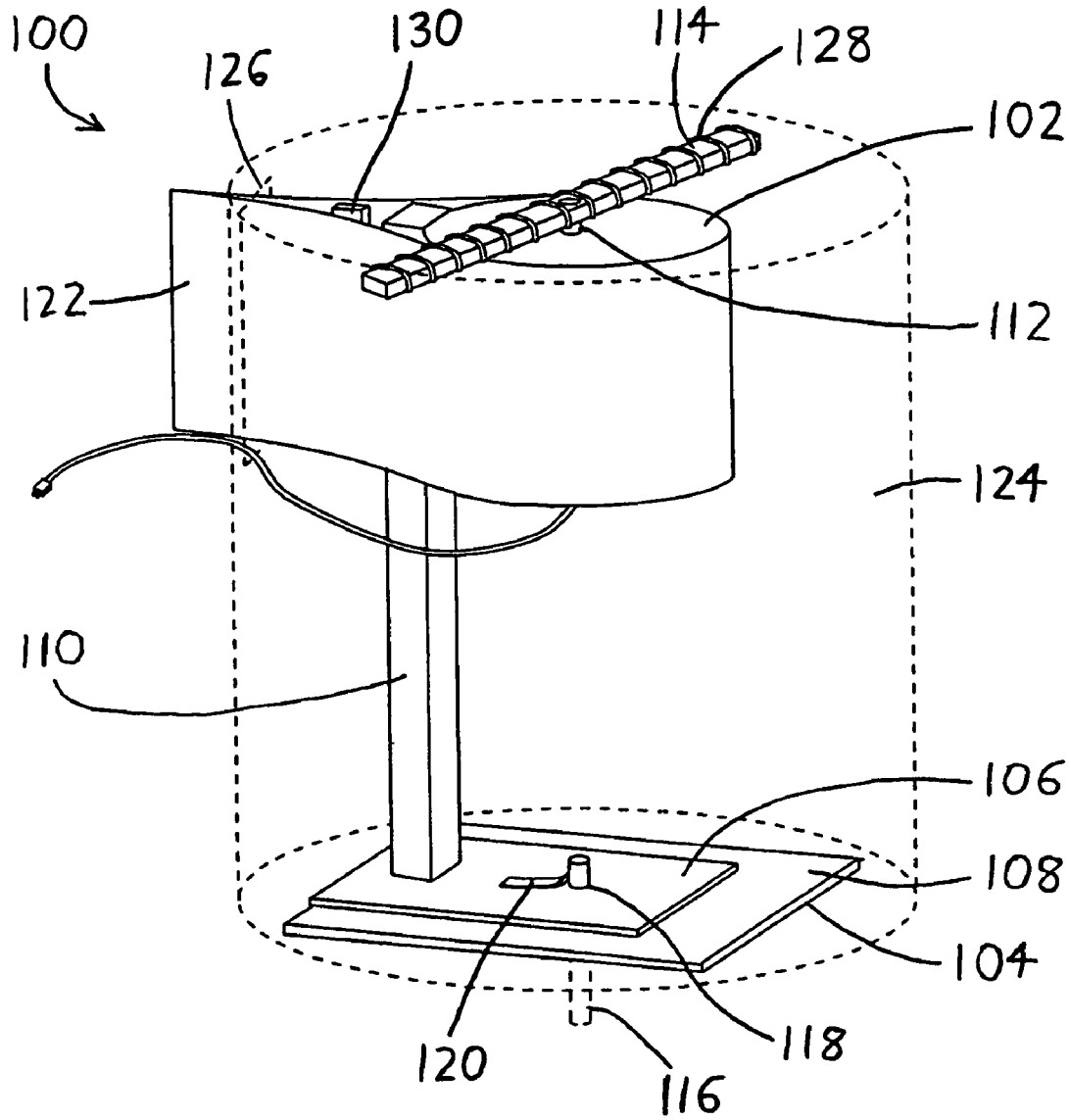

STRAY VOLTAGE SUPPRESSION DEVICE

CROSS-REFERENCE TO RELATED APPLICATIONS

This application claims priority under 35 USC §119(e) to U.S. Provisional Patent Application 60/638,508 filed 22 Dec. 2004, the entirety of which is incorporated by reference herein.

FIELD OF THE INVENTION

This document concerns an invention relating to devices for reducing or eliminating stray voltage, particularly on dairy farms and in other settings where animals are raised.

BACKGROUND OF THE INVENTION

Standard electrical distribution systems serving farms and rural areas have a high voltage wire and a neutral wire as the primary power-bearing components. These two wires provide the complete electrical path required in any circuit, i.e., between a generator and a load (a powered electrical appliance/device). In a grounded system, the neutral line is connected to the earth to allow a portion of the current supplied to a load to return to the generator (usually the substation which supplies the current) through the earth.

In farms having numerous loads spread out over a large area, such as milking parlor appliances, electric fences, utility shed appliances, yard lamps, etc., numerous grounding points may be distributed over the area. Owing to the currents flowing through the earth from different grounding points, small voltages can develop at or near these points, and consequently in nearby objects in immediate contact with the earth. When these voltages are measured between two grounding points that livestock or other animals can simultaneously touch, these voltages are called "stray voltages." Stray voltage is of significant concern to farmers because if the grounding points are simultaneously touched by an animal, a current will flow through the animal from the stray voltage. It is believed that stray voltage can cause changes (generally negative) in animal behavior, as well as symptoms such as decreased feed intake and/or milk production. Thus, there is significant interest in finding methods and devices for reducing or eliminating stray voltages.

SUMMARY OF THE INVENTION

The invention involves a stray voltage suppression device which is intended to at least partially solve the aforementioned problems. To give the reader a basic understanding of some of the advantageous features of the invention, following is a brief summary of a preferred version of the device, with reference being made to the accompanying drawing to assist the reader's comprehension. Since this is merely a summary, it should be understood that more details regarding the preferred versions may be found in the Detailed Description set forth elsewhere in this document. The claims set forth at the end of this document then define the various versions of the invention in which exclusive rights are secured.

Looking to the Figure for a simple exemplary version of the device (which is indicated generally by the reference numeral 100), the device 100 includes a motor 102 (preferably an AC electric motor) supported above the ground by a base 104. In the illustrated device 100, the base 104 is formed of a conductive (metal) upper base plate 106 which is supported by a lower base plate 108. The lower base plate 108, which is provided to increase the area of the base 104, may be nonconductive (e.g., formed of wood or plastic). A support arm 110 extending between the base 104 and the motor 102 may also be provided, and this is preferably formed of conductive materials, and is connected between the outer surface of the motor 102 and the conductive portion of the base 104 (the upper base plate 106) so that the outer surface of the motor 102 conductively communicates with the base 104.

The motor 102 bears a rotor 112 to which an at least partially conductive vane 114 is attached, so that when the motor 102 is activated, the vane 114 will rotate. Most preferably, the base 104 (and any support arm 110 extending therefrom) is configured to orient the motor 102 and vane 114 so the vane 114 is rotatably driven by the motor 102 in planes oriented at least substantially parallel to the ground upon which the base 104 rests. A conductive member 116 then extends from the motor 102 into the ground. Where the motor 102 is in conductive communication with the base 104 (as by conductively connecting the motor 102 to the base 104 by the support arm 110, as discussed above), such grounding can be provided by extending a conductive stake or other member from the base 104 into the ground. In the preferred device 100, this is done by extending a conductive member 116 through an aperture 118 in the upper and lower base plates 106 and 108, and having a flexible metal leaf 120 or other conductive engagement extend from the upper base plate 106 to bear against the inserted member 116. Alternatively (or additionally), a wire or other conductive conduit could simply extend from the motor 102 to the conductive member 116, or the motor 102 could otherwise be provided with a conductive connection to the ground about the device 100.

When the device 100 is installed at or near a location where stray voltages are measured, with the motor casing being grounded (as by the conductive member 116) and with the motor 102 being powered to rotate the vane 114 (preferably in a clockwise direction), nearby stray voltages are found to decrease or disappear. The principles/mechanisms by which the nearby stray voltages are reduced are unknown. However, in at least some cases, spaced rings of higher-voltage regions centered about the device 100 may remain. It has been found that when conductive fins 122 are defined on the casing of the motor 102 (and/or possibly on conductively connected structure, such as on the support arm 110 and/or upper base plate 106), these voltages can also be reduced or eliminated, with the reasons for such reduction again being unknown. Such a fin 122 is provided on the exemplary device 100 by wrapping a conductive (e.g., sheet metal) strip about the casing of the motor 102 and conductively attaching it thereon, and joining the ends of the strip together (as by welding). Any such fins 122 are preferably at least substantially planar, and are preferably oriented parallel to the axis of the rotor 112 of the motor 102 (and thus vertically in the device 100). It is believed that the fin 122 may provide the best reduction of stray voltages if the fin 122 is pointed toward a grounded structure distant from the device 100 (e.g., a ground on a powerline pole, a transformer box, etc.).

Since the device 100 will usually be used outdoors, it is preferably provided within an enclosure 124 such as a drum/barrel (illustrated in phantom in the Figure), whereby the enclosure 124 at least substantially surrounds the vane 114 and motor 102 and shelters them from rain and wind.

The enclosure 124 bears an opening (not shown) allowing the conducting member 116 to extend from the base 104 into the ground, and similarly includes a window 126 from which the fin 122 may extend (assuming the fin 122 has such a size that it would otherwise interfere with the enclosure 124). The enclosure 124 may also bear vents and the like (not shown) to better promote airflow between the interior and exterior of the enclosure 124, and promote cooling of the motor 102. The vane 114 is preferably situated above the motor 102 (and between the motor 102 and the top wall of the enclosure 124) rather than below it so that the vane 114 may assume a size closely approaching the interior diameter of the enclosure 124 without interference from the support arm 110.

Also, to allow users to install the device 100 where desired, the device 100 is preferably designed to be lightweight and portable so that a user can lift and relocate it to different areas. When the enclosure 124 is formed from a conventional plastic waste pail or chemical/fertilizer barrel, this allows a user to relatively easily relocate the device 100 as needed.

Further advantages, features, and objects of the invention will be apparent from the further discussion below.

BRIEF DESCRIPTION OF THE DRAWINGS

THE FIGURE is a simplified perspective view of a basic version of the stray voltage suppression device, with this device 100 including a conductive vane 114 which is supported by a base 104 to rotate above some area of the ground where stray voltages are present (with the vane 114 being driven by motor 102).

DETAILED DESCRIPTION OF PREFERRED VERSIONS OF THE INVENTION

Keeping in mind that the device 100 discussed in the foregoing Summary is merely an exemplary preferred one, it should be understood that the invention may be modified in many respects, and may include features additional to or different from those discussed above. Two important details relate to enhancements which appear to increase the area of coverage of the device 100, i.e., which increase the area about the device 100 wherein stray voltages are reduced or eliminated. First, it has been found that when the vane 114 is wound with one or more conductors, such as the wire winding 128, this appears to increase the area of coverage (with more windings seeming to increase the area covered). However, since this has only been tested with copper windings 128 about a cold-rolled steel vane 114, it is not known whether this effect merely occurs owing to the windings 128 increasing the conductivity of the vane 114, or whether the same effect might be attained by simply forming the vane 114 of more conductive material such as copper.

Secondly, tests seem to indicate that when the fin 122 (or its conductively connected support arm 110 and/or upper base plate 106) are magnetized, the area of coverage may increase. A particularly preferred arrangement is shown in the FIGURE, wherein magnets 130 have been installed within the fin 122 at its opposing sides (only one of the magnets 130 being visible).

It is emphasized that the shapes and sizes of the various components of the device 100 described above can be varied in many respects. Following is a list of exemplary modifications.

Regarding the base 104, the upper base plate 106 and lower base plate 108 could be eliminated, and the base 104 could simply be formed of the bottom wall of the enclosure 124 (so long as this arrangement sufficiently supports the support arm 110, if any).

It is possible that the support arm 110 could be eliminated entirely, and the motor 102 could simply rest on the base 104 (which could be formed only by the lower wall of the enclosure 124). However, this arrangement is not preferred because the motor 102 is then more susceptible to contact with water entering through the aperture 118 provided for the conductive member 116 and/or through the window 126 for the fin 122, and to contact with any water that may pool in the bottom of the enclosure 124 after entering. However, this may not be a concern if the motor 102 is sufficiently water-resistant.

It is also possible that the support arm 110 could itself form the conductive member 116 (i.e., the support arm 110 could effectively define an elongated stake), or could have the conductive member 116 extend from its bottom, with the conductive member 116 extending through the lower wall of the enclosure 124 and into the ground.

It is emphasized that the base 104 can assume practically any size and shape. The base 104 desirably fits entirely within the enclosure 124, unless the enclosure 124 has no floor and merely serves as a sort of covering hood, in which case the base 104 may extend beyond the perimeter of the enclosure 124. The grounding of the motor 102 need not occur via insertion of the conductive member 116 from the base 104, and as previously noted, grounding can occur by other means of conductively connecting the motor 102 to ground (as by extending a wire/conductor to ground from the motor 102, or from the conductively connected fin 122, support arm 110, etc.).

More than one fin 122 might be provided, for example, by using two conductive strips rather than one in the device 100, and sandwiching the motor 102 between them to define fins 122 extending from opposing sides of the motor 102 (in which case an additional fin window 126 may need to be formed in the enclosure 124). However, fins 122 need not be formed of such a conductive strips, and could instead be (for example) welded directly onto the casing of the motor 102. Fins 122 may also or alternatively be functional if welded or otherwise affixed to the support arm 110, upper base plate 106, or other conductive structure in electrical communication with the casing of the motor 102 and/or ground.

The motor 102 is preferably a conventional 120V AC motor, though it is believed that a DC motor (and potentially other forms of motors, e.g., hydraulic motors and the like) might work as well.

The vane 114 can also assume a wide variety of sizes and configurations. As an example, additional arms might be provided on the vane 114 (e.g., the vane 114 could be formed similarly to a multi-arm propeller), and/or such arms could be made broader and more blade-like. It is also possible that the vane 114 may not need arms, and could instead be formed in a wheel shape or the like, though such an option has not yet been tested.

The enclosure 124 preferably takes the form of a conventional plastic garbage pail, fertilizer/chemical barrel, or similar container having both a floor and a removable lid, though enclosures 124 of other sizes, configurations, and materials are possible. The primary purpose of the enclosure 124 is to protect the motor 102 from the elements and to maintain the safety of bystanders who might otherwise be struck by the rotating vane 114, and thus the enclosure 124 might be eliminated if these objectives are met in other ways. As one example, if the motor 102 is sufficiently resistant to water and the elements, the need for the enclosure 124 is reduced. Similarly, if a shield or shell surrounds the vane 114 to protect bystanders, the need for an enclosure 124 is similarly reduced. A protective barrier is also less essential if the vane 114 is formed in a wheel shape (as discussed previously), and this arrangement does not require that the entirety of the wheel need be conductive. For example, nonconductive semicircular appendages could be affixed to the opposing elongated sides of the vane 114 so that it effectively defines a rotating wheel with a conductive vane situated therein.

The inventor has also experimented with highly portable versions of the invention, e.g., wearable versions, so that farmers and others who work at areas susceptible to stray voltage problems (as well as livestock and other animals) might be rendered less susceptible to stray voltage. Wearing a rotationally driven conductive vane of any substantial size is generally impractical, but the inventor believes that some relief may be obtained by use of a device implementing the fin, magnet, and/or conductive winding concepts discussed earlier. In a preferred version of the wearable invention, an elongated magnet (e.g., a rod magnet of 3 inches length and 0.75 inches diameter) has fins attached to it. The fins can be formed similarly to the fin 122 by folding one or more conductive strips about the magnet, but a preferred approach is to wrap conductive wire about the magnet (either once or with several windings extending about the magnet), and then twisting the ends of the wire together to form a twisted tail-like fin extending from the magnet in a radial direction. In a prototypical version of the invention, two wires are separately wrapped about the magnet to form two tails/fins, one adjacent each of the magnet's opposing poles. The magnet is then placed in a container (such as in a section of PVC tubing) to which a clip is attached, allowing a user to clip it to his/her clothing or to an animal's collar. The magnet may be secured within the PVC tubing by (for example) filling the interior of the tubing with expandable polyurethane foam, thereby affixing the magnet in location, and capping the opposing ends of the tubing. Preferably, the magnet is secured so that when it is clipped onto a user, the fins (as defined by the twisted wire ends or otherwise) point away from the user.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A stray voltage suppression device comprising:

a. a rotating vane, the vane being at least partially conductive;

b. a base supporting the vane above the earth, whereby the vane rotates in planes oriented at least substantially parallel to the earth;

c. a conductive member protruding downwardly from the base into earth;

the device being portable, whereby a user can lift the base, thereby removing the conductive member from the earth, and relocate the base to different areas along the earth, with the conductive member protruding downwardly into the earth at such different areas.

2. The stray voltage suppression device of claim 1 further comprising an enclosure at least substantially surrounding the base and vane, wherein the vane rotates between the base and the enclosure, and wherein the conductive member is defined by an elongated rigid member terminating in a free end insertable into the earth.

3. The stray voltage suppression device of claim 1 further comprising a motor rotatably driving the vane.

4. The stray voltage suppression device of claim 3 wherein:

a. the motor is rigidly supported above the base by an elongated support arm, and b. the vane rotates above the base and motor.

5. The stray voltage suppression device of claim 3 further comprising an enclosure at least substantially surrounding the vane and motor, whereby the enclosure at least substantially blocks wind and rain from the vane and motor.

6. The stray voltage suppression device of claim 3 further comprising a stationary fin affixed to and extending outwardly from the motor, the fin terminating in an at least substantially planar tip protruding through the enclosure.

7. The stray voltage suppression device of claim 1 further comprising a conductive fin conductively connected to the base, the fin being oriented at least substantially vertically and terminating in an at least substantially planar tip.

8. The stray voltage suppression device of claim 1 wherein the vane includes an elongated member with a conductor wound thereon, the conductor also being wound about an axis which is neither parallel to nor coincident with the axis about which the vane rotates.

9. The stray voltage suppression device of claim 1 wherein the base is defined by a generally planar surface extending horizontally below the vane, the surface having an area at least substantially equal to, or greater than, the area swept by the rotating vane.

10. A stray voltage suppression device comprising:

a. an at least partially conductive vane;

b. a motor rotating the vane;

c. a base supporting the motor and vane above the earth;

d. an enclosure at least substantially surrounding the vane and motor, whereby the enclosure at least substantially blocks rain from the vane and motor; and e. an elongated conductive member in conductive communication with the motor, the conductive member terminating in a free end, wherein the free end is insertable into the earth upon which the base rests.

11. The stray voltage suppression device of claim 10 wherein the vane includes a conductor wound thereon.

12. The stray voltage suppression device of claim 10 wherein:

a. the base is defined by a generally planar surface extending horizontally below the vane, the surface having an area at least substantially equal to, or greater than, the area swept by the rotating vane; and b. the conductive member is affixed to the base.

13. The stray voltage suppression device of claim 10 wherein the base orients the vane to rotate in at least substantially horizontal planes.

14. The stray voltage suppression device of claim 12 wherein the conductive member is rigidly affixed to the base to protrude downwardly therefrom.

15. The stray voltage suppression device of claim 10 wherein the device is portable, whereby a user can lift and relocate the base to different areas along the earth.

16. The stray voltage suppression device of claim 10 further comprising a fin:

a. affixed to and extending outwardly from the motor, and b. terminating in an at least substantially planar tip extending outside of the enclosure.

17. The stray voltage suppression device of claim 16 wherein:

a. the motor has a rotor whereupon the vane is mounted; and b. the fin extends in planes oriented at least substantially parallel to the rotor.

18. A stray voltage suppression device comprising:

a. an electric motor having a rotor extending upwardly therefrom;

b. an at least partially conductive vane affixed to the rotor, whereby the motor rotatably drives the vane;

c. a base supporting the motor above the earth, the base being configured to orient the motor and vane so the vane is rotatably driven by the motor in planes oriented at least substantially parallel to the earth;

d. a rigid conductive member extending downwardly below the base, the conductive member terminating in a free end, whereby the free end may extend downwardly into the earth beneath the base.

19. The stray voltage suppression device of claim 18 further comprising a conductive fin protruding from the motor, the fin terminating in an at least substantially planar tip.

20. The stray voltage suppression device of claim 18 further comprising an enclosure at least substantially surrounding the vane and motor and sheltering the vane and motor from wind and rain.

* * * * *